US008104815B2

(12) United States Patent
Chen et al.

(10) Patent No.: US 8,104,815 B2
(45) Date of Patent: Jan. 31, 2012

(54) ARM FOLDING MECHANISM FOR USE IN A VEHICLE-MOUNTED RADIATION IMAGING SYSTEM

(75) Inventors: Zhiqiang Chen, Beijing (CN); Hua Peng, Beijing (CN); Shangmin Sun, Beijing (CN); Quanwei Song, Beijing (CN); Jinning Liang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 0 days.

(21) Appl. No.: 13/114,367

(22) Filed: May 24, 2011

(65) Prior Publication Data

US 2011/0220801 A1 Sep. 15, 2011

Related U.S. Application Data

(62) Division of application No. 12/317,622, filed on Dec. 24, 2008, now Pat. No. 7,984,940.

(30) Foreign Application Priority Data

Dec. 27, 2007 (CN) ..... 2007 1 0304375

(51) Int. Cl.
*A61G 3/00* (2006.01)

(52) U.S. Cl. ..... 296/24.38; 378/57

(58) Field of Classification Search ..... 296/24.38, 296/165, 171; 29/469; 378/57; 312/7.2; 348/825, 837
See application file for complete search history.

(56) References Cited

U.S. PATENT DOCUMENTS

| | | | | |
|---|---|---|---|---|
| 3,554,245 | A | 1/1971 | Eynon | |
| 3,674,162 | A | 7/1972 | Smith | |
| 4,278,219 | A | 7/1981 | Finance | |
| 4,371,017 | A | 2/1983 | Lindblom | |
| 4,907,667 | A | 3/1990 | Yamamoto et al. | |
| 4,938,526 | A | 7/1990 | Sannomiya et al. | |
| 4,983,092 | A | 1/1991 | Richards | |
| 5,184,933 | A | 2/1993 | Pei-qian et al. | |
| 5,195,865 | A | 3/1993 | Koehl | |
| 5,200,674 | A | 4/1993 | Fujimoto et al. | |
| 5,295,318 | A | 3/1994 | Schaeff | |
| 5,330,308 | A | 7/1994 | Armando et al. | |
| 5,400,447 | A | 3/1995 | Pokorny | |
| 5,522,677 | A | 6/1996 | Schlecht | |
| 5,590,851 | A | 1/1997 | Ackerman | |
| 5,645,309 | A | 7/1997 | Graf | |
| 5,692,028 | A | 11/1997 | Geus et al. | |
| 5,838,759 | A * | 11/1998 | Armistead | 378/57 |
| 5,886,673 | A | 3/1999 | Thomas | |
| 6,010,178 | A | 1/2000 | Hahn et al. | |
| 6,058,158 | A * | 5/2000 | Eiler | 378/57 |

(Continued)

*Primary Examiner* — Kiran B. Patel
(74) *Attorney, Agent, or Firm* — Kenyon & Kenyon LLP

(57) ABSTRACT

An arm-folding mechanism for use in a vehicle-mounted radiation imaging system. The vehicle includes a vehicle body behind a driving cab. The vehicle body includes a generator cabin and a control cabin. The arm-folding mechanism includes a vertical detection arm, a main arm frame, and a hinged mechanism hingedly connecting the vertical detection arm with the main arm frame. The hinged mechanism includes: a first connection arrangement having a free end and a fixed end fixedly connected with or integral with the main arm frame; a second connection arrangement fixedly connected with the vertical detection arm; and an intermediate arrangement connecting the first connection arrangement with the second connection arrangement so that the vertical detection arm can rotate relative to the main arm frame. The bottom of the first connection arrangement is at the same level as or above the bottom of the main arm frame.

17 Claims, 5 Drawing Sheets

U.S. PATENT DOCUMENTS 6,086,312 A 7/2000 Ziaylek et al.
6,108,948 A 8/2000 Tozawa et al.
6,286,174 B1 9/2001 Zimmer
6,435,715 B1 * 8/2002 Betz et al. ..... 378/197
6,439,249 B1 8/2002 Pan et al.
6,634,705 B1 10/2003 Zheng
6,636,581 B2 * 10/2003 Sorenson ..... 378/58
6,666,152 B2 12/2003 Tsai
6,763,635 B1 7/2004 Lowman
6,769,732 B2 8/2004 Sakyo
6,785,357 B2 8/2004 Bernardi et al.
6,920,197 B2 * 7/2005 Kang et al. ..... 378/57
6,936,820 B2 * 8/2005 Peoples ..... 250/336.1
6,938,454 B2 9/2005 Strasser et al.
7,082,186 B2 * 7/2006 Zhao et al. ..... 378/57
7,165,650 B2 * 1/2007 Korchagin et al. ..... 182/82
7,215,737 B2 * 5/2007 Li et al. ..... 378/57
7,352,843 B2 4/2008 Hu et al.
7,369,643 B2 5/2008 Kotowski et al.
7,497,618 B2 3/2009 Chen et al.
7,519,148 B2 4/2009 Kotowski et al.
7,614,351 B2 11/2009 Piretti
7,660,386 B2 * 2/2010 Meng et al. ..... 378/57
7,783,004 B2 8/2010 Kotowski et al.
7,819,580 B2 * 10/2010 Song et al. ..... 378/189
7,876,880 B2 * 1/2011 Kotowski et al. ..... 378/57
2003/0089388 A1 5/2003 Cassagne
2004/0177979 A1 9/2004 Rubie et al.
2006/0157605 A1 7/2006 Ramun et al.
2008/0122736 A1 5/2008 Ronzani et al.
2009/0271068 A1 10/2009 Shi et al.
2010/0140016 A1 6/2010 Raappana
2010/0189226 A1 7/2010 Kotowski et al.
2011/0026673 A1 2/2011 Mastronardi et al.
2011/0038453 A1 * 2/2011 Morton et al. ..... 378/57

* cited by examiner

ARM FOLDING MECHANISM FOR USE IN A VEHICLE-MOUNTED RADIATION IMAGING SYSTEM

CROSS-REFERENCE TO RELATED APPLICATIONS

This application is a divisional application of U.S. patent application Ser. No. 12/317,622 filed on Dec. 24, 2008, now U.S. Pat. No. 7,984,940 which claims priority to Chinese Application No. 200710304375.7, filed Dec. 27, 2007, the entirety of each of which is herein incorporated by reference.

FIELD OF THE INVENTION

The present invention relates to the technical field of radiation detection, and more particularly, to an arm-folding mechanism for use in a vehicle-mounted radiation imaging system.

BACKGROUND INFORMATION

Security inspection is of great significance in the fields of anti-terrorism and the fight against drug trafficking and smuggling, etc. People have been paying much more attention to security inspection on civil aviation since the U.S. Sep. 11, 2001 attacks. With the comprehensive development of the fight against drug trafficking and smuggling, the requirement for the inspection of air container and railway baggage etc. is much more stringent.

With reference to FIGS. 8, 9, 10, 11A, 11B and 11C, a vehicle-mounted imaging system 1000 previously used by the present applicants generally includes a vehicle 600 carrying the imaging system 1000 and an arm-folding mechanism 44. The vehicle 600 includes a vehicle body and a driving cab 42. The vehicle body is divided into a generator cabin 41 and a detection system control cabin 40 along the traveling direction A of the vehicle. The arm-folding mechanism 44, when in a folded state, is compactly disposed on the top of the vehicle body as shown in FIG. 9 so as to be carried and transported by the vehicle to places in need. A vertical detection arm of the arm-folding mechanism 44 is positioned on an equipment room. There is no spatial requirement for the equipment room, so the equipment room can be provided very low such that the folded vertical detection arm can be placed on top of it. The folded vertical detection arm is usually located on the side face of the main arm frame of the arm-folding mechanism 44 and the lowest point of the vertical detection arm is lower than the lowest point of the main arm frame. A revolving bearing portion of the main arm frame is positioned above the generator cabin and extends slantways downwards from the main arm frame to be lower than the plane on which the highest point of the top of the generator cabin is, so the top of the generator cabin has to be made into a stepped shape, i.e., it has two parallel planes at different heights. Thus, in such a vehicle-mounted imaging system, the revolving point of the original arm-folding mechanism occupies some space of the cabin, and a relatively larger subsidiary arm frame occupies more space of the cabin. The manufacture and processing of such a generator cabin is complex so that the cost of production is high.

The generator cabin 41 is close to the driving cab 42. An accelerator is located at the position of a passage formed by the unfolded vertical detection arm and the main arm frame so as to carry out radiation imaging detection, so the control cabin 40 is close to the accelerator, resulting in a harmful influence of radiation to an operator. The generator cabin 41 is not a human-operating area, so the generator cabin 41 configured to have a low area has no other defects except the complexity in production. However, in order to achieve a certain radiation protection level, the design of the system consequentially makes the control cabin 40 in the status of detection closer to the accelerator so that the walls and top of the control cabin need more anti-radiation materials. Hence, the load of the vehicle-mounted system is increased, the adaptability of the vehicle-mounted system to the vehicle load limitation regulations of each country is reduced, and the cost of production is increased.

When the arm-folding mechanism is in use, the folded arm-folding mechanism firstly needs to be rotated, within a plane that is parallel to the ground surface, about 90° from the vehicle body so that the arm-folding mechanism is substantially perpendicular to the traveling direction of the vehicle, and then the vertical detection arm is rotated downwards about 90° so that the vertical detection arm is substantially perpendicular to the main arm frame as well as the ground surface, as shown in FIG. 8. At this time, the arm-folding mechanism is unfolded, and the vertical detection arm is on one side of the vehicle and hung on the main arm frame by a hinged mechanism such that a detection passage area 500 for allowing the passage of the objects to be detected is formed. The equipment room rotatably moves to the other side of the vehicle body, and the operator in the control cabin 40 makes corresponding control operation.

SUMMARY OF THE INVENTION

Embodiments of the present invention provide an arm-folding mechanism usable in a vehicle-mounted radiation imaging system. Positions of a generator cabin and a control cabin are exchanged, thereby protecting the operator from radiation while reducing the use of the anti-radiation material. Meanwhile, the arm-folding mechanism is also advantageous in avoiding limiting the moving space of the operator caused by the occupation of some space to the cabin, so that the operator can comfortably work in the control cabin.

Additionally, it is known by those skilled in the art that the weight of the vehicle-mounted detection system is always an important index restricting its development, and a comparatively lighter vehicle weight and axle load will make it adaptable to requirements of regulations of more countries. The position of the generator cabin is exchanged with the position of the control cabin of the vehicle-mounted detection system by moving the control cabin forward such that the amount of anti-radiation material used in the control cabin is greatly reduced, and therefore, the weight of the control cabin is reduced. However, since the main arm frame occupies some space of the control cabin, a part of the top of the control cabin, after being moved forward, must sink downwards, which causes the moving space of the operator to be diminished and the difficulty in processing the cabin increased. This shortcoming is also overcome by the arm-folding mechanism of the present invention.

In the arm-folding mechanism of the present invention, the control cabin is positioned forward on the condition that the spatial dimension of the control cabin is unchanged, and a part of the top of the control cabin does not need to sink, which reduces the difficulty in processing the equipment room Thus, an object of the present invention is to provide an improved arm-folding mechanism for use in a vehicle-mounted imaging system with regard to the aforesaid shortcomings in the prior art, the arm-folding mechanism allows a hinged portion of the main arm frame to be located on a higher plane on the top of the control cabin, such that the moving space for the operator is increased to provide a more comfortable environment for the operator. The cost and difficulty of processing the cabin is decreased because the arm-folding mechanism allows the control cabin to be exchanged with the generator cabin without diminishing the dimension of the control cabin such that the anti-radiation material used in the control cabin is greatly reduced and further the on-board weight is lightened.

It is another object of the present invention to provide a novel arm-folding mechanism that reduces the self weight of a conventional arm-folding mechanism.

It is a further object of the present invention to provide an improved arm-folding mechanism for use in a vehicle-mounted imaging system in order to realize the folding and unfolding of the vertical detection arm in a new manner and ensure the posture of the vertical detection arm when in the status of detection.

It is another object of the present invention to provide an vehicle-mounted imaging system having the arm-folding mechanism of the present invention, where, viewed from the traveling direction of the vehicle, the generator cabin is behind the control cabin which is close to the driving cab, and the top of the control cabin and the top of the generator cabin can be a single plane structure.

The above objects of the present invention are achieved by the technical solutions described below.

In an example embodiment of the present invention, an arm-folding mechanism for use in a vehicle-mounted radiation imaging system is provided. The vehicle includes a vehicle body behind a driving cab. The vehicle body includes a generator cabin and a control cabin. The arm-folding mechanism includes a vertical detection arm, a main arm frame, and a hinged mechanism hingedly connecting the vertical detection arm with the main arm frame. The hinged mechanism includes: a first connection arrangement having a free end and a fixed end fixedly connected with or integral with the main arm frame; a second connection arrangement fixedly connected with the vertical detection arm; and an intermediate arrangement connecting the first connection arrangement with the second connection arrangement so that the vertical detection arm can rotate relative to the main arm frame. The bottom of the first connection arrangement is at the same level as or above the bottom of the main arm frame.

In a preferred example embodiment, viewed from a working position, the first connection arrangement is close to a front side of the main arm frame.

In a preferred example embodiment, the intermediate arrangement includes a subsidiary arm frame and a revolving axle fixedly connected to each other.

In a preferred example embodiment, the subsidiary arm frame includes a fixed flange connected with the vertical detection arm and an axle sleeve fixedly connected with the revolving axle.

In a preferred example embodiment, at an end of the revolving axle of the subsidiary arm frame aligned with the fixed flange is provided a flange for securing the vertical detection arm and a bearing axle carrying the vertical detection arm and embedded in a hole of the end.

In a preferred example embodiment, the axle sleeve can be divided into upper and lower half axle sleeves detachably connected, the upper half axle sleeve being connected with or integral with the body of the subsidiary arm frame, a slot simultaneously being axially arranged on the outer diameter of the revolving axle and having the same length as the axial length of the axle sleeve such that the upper and lower half axle sleeves are embedded in the slot by a fastening arrangement.

In a preferred example embodiment, in a working status, the second connection arrangement is a protruding structure extending from the vertical detection arm to the main arm frame and beyond the width of the vertical detection arm, whereby the size of the detection passage is guaranteed.

An example embodiment of the present invention is directed to a vehicle-mounted radiation imaging system that uses the arm-folding mechanism of the present invention.

In a preferred example embodiment, the control cabin is adjacent to the driving cab, and the generator cabin is behind the control cabin.

In a preferred example embodiment, the top of the control cabin is a flat-top structure, and the space of the control cabin is suitable for operators to operate therein.

Some beneficial effects provided by the example embodiments of the present invention are as follows.

1. According to an example embodiment of the present invention, the positions of the control cabin and the generator cabin are exchanged as compared to a conventional system, without diminishing the spatial dimension of the control cabin, and the amount of the anti-radiation material of the control cabin body is greatly reduced so that the on-board weight is lightened.
2. According to an example embodiment of the present invention, the self weight of a preferred arm-folding mechanism of the present invention is greatly reduced compared with the prior art arm-folding mechanism. As shown in FIGS. 11A, 11B and 11C, especially 11C, the prior art arm-folding mechanism is huge in volume and connected with the vertical arm by two flanges 51, 52 and with the main arm frame by the revolving axle 53.
3. According to an example embodiment of the present invention, the top of the cabin does not need to sink any more, which simplifies the construction of the cabin of the prior art system.

DETAILED DESCRIPTION

In order to describe the technical solution provided by the present invention more clearly and explicitly, the present invention will be described in detail with reference to the following preferred embodiments and the accompanying drawings.

"Front" and "back," referred to hereinafter, are terms relative to a forward traveling direction A of the vehicle 600. "Above" and "under" indicate relative positions in a height direction of the vehicle, where the bottom of the vehicle is the side of the vehicle closest to the ground when the vehicle is in a traveling position, and the top of the vehicle is the side of the vehicle furthest from the ground when the vehicle is in a traveling position.

Additionally, in the present description, "left side of the vehicle body" and "right side of the vehicle body" are the left side and right side of a viewer when looking at the vehicle while standing in front of the head of the vehicle when in a stationary state.

Figure 3:
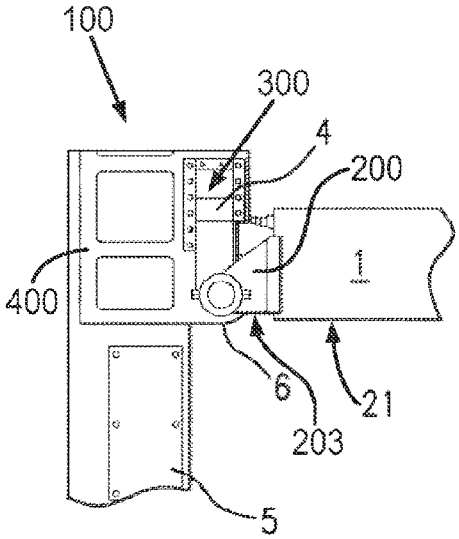
FIG. 3 shows a working status of the arm-folding mechanism, according to an example embodiment of the present invention.

FIG. 3 shows the arm-folding mechanism 100 according to an example embodiment of the present invention when in an unfolded or in-use status, which includes a vertical detection arm 5, a main arm frame 1, and a hinging structure hingedly connecting the vertical detection arm 5 with the main arm frame 1, the hinging structure including a first connection arrangement 200 connected with the main arm frame 1 and a second connection arrangement 400 connected with the vertical detection arm 5, as well as an intermediate arrangement 300 connecting the first connection arrangement 200 with the second connection arrangement 400 by relative rotation, where a bottom plane 203 of portion 2 of the first connection arrangement 200 is parallel to a bottom horizontal plane 21 of the main arm frame 1 and at the same level as the bottom horizontal plane 21 or higher than the bottom horizontal plane 21.

Figure 1:
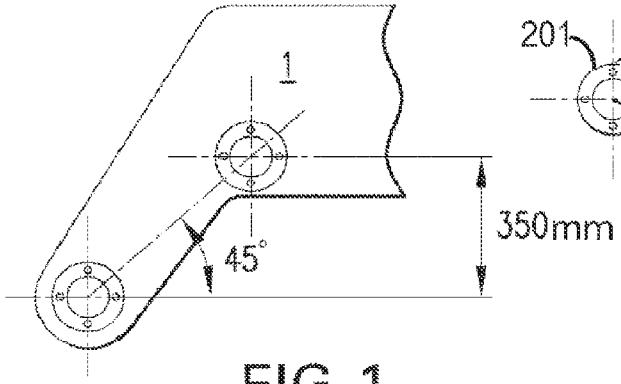
FIG.1 PRIOR ART
FIG. 1 shows a prior art connection arrangement on a main arm frame in the hinged mechanism of an arm-folding mechanism.
Figure 2:
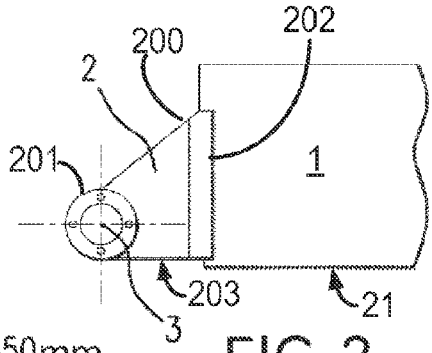
FIG. 2 is an improved connection arrangement, according to an example embodiment of the present invention.

The improvement to the first connection arrangement over the prior art can be clearly seen from FIG. 1 and FIG. 2. In the prior art, as shown in FIG. 1, a connection arrangement and the main arm frame 1 are integrally connected and extend slantways downwards, which causes the technical shortcoming of occupying some space of the control cabin. On the other hand, referring to FIG. 2, the first connection arrangement 200, according to an example embodiment of the present invention, includes a body portion 2 and a revolving bearing portion 3. However, other hinged arrangements can be used.

Figure 4:
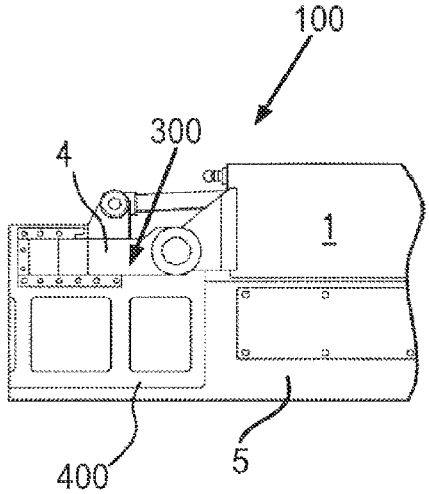
FIG. 4 shows a folded status of the arm-folding mechanism of FIG. 3, according to an example embodiment of the present invention.

In FIG. 2, the body portion 2 of the first connection arrangement 200 of the present invention is parallel to the main arm frame 1. The bottom plane 203 of the first connection arrangement 200 is preferably above the bottom horizontal plane 21 of the main arm frame 1. The body portion 2 as shown in FIG. 2 is preferably a triangular plate-like element or other shapes that are good for reducing the amount of the materials used and the load of the vehicle. The body portion 2 can be seen more clearly in FIGS. 7A and 7B. On the frontal end of the main arm frame 1, the body portion 2 is as close as possible to the bottom horizontal plane 21 of the main arm frame 1 and is connected at a fixed end 202 to the main arm frame 1 close to one side of the main arm frame 1 (said side is a side of the main arm frame 1 facing forwardly in an unfolded state in the present embodiment), and the revolving bearing portion 3 is disposed on a hinged end 201 of the body portion 2 (as shown in FIG. 2). As shown in FIG. 3 and FIG. 4, the second connection arrangement 400 is preferably a vertical detection arm protruding structure 6 protruding from the top of the vertical detection arm 5 (in the working status) because the vertical detection arm protruding structure 6 can guarantee the size of the detection passage 500 after the upward movement of the revolving hinged axle. The vertical detection arm protruding structure 6 can be connected with the vertical detection arm 5 in a conventional manner. For the purpose of reducing the weight of the second connection arrangement 400 and the amount of the material used, the second connection arrangement 400, as shown in FIG. 3, can be a shape with the middle hollowed-out.

Figure 5:
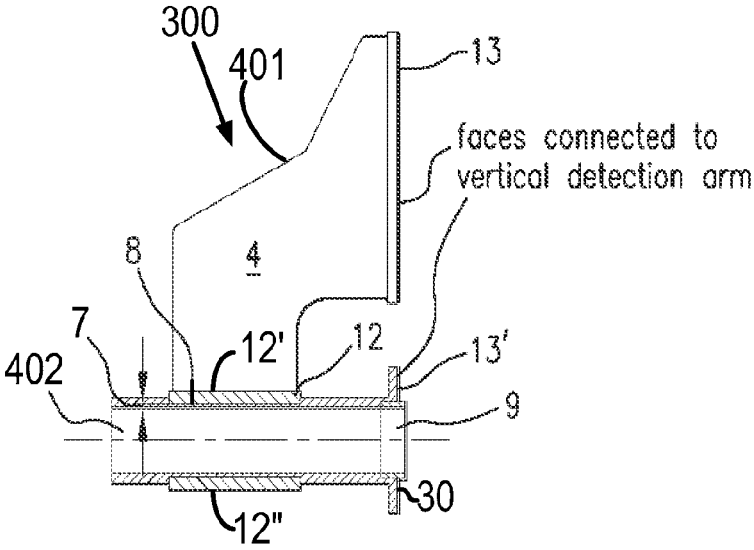
FIG. 5 is a side view of a second connection arrangement on a vertical detection arm in the hinged mechanism of the arm-folding mechanism, according to an example embodiment of the present invention.
Figure 6:
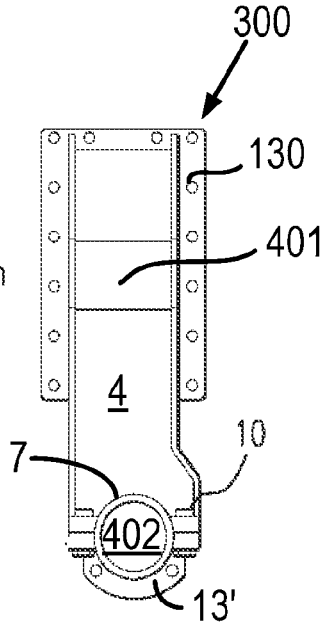
FIG. 6 is a frontal view of the second connection arrangement on the vertical detection arm in the hinged mechanism of the arm-folding mechanism, according to an example embodiment of the present invention.

An intermediate arrangement 300 as shown in FIG. 5 and FIG. 6 includes a subsidiary arm frame 4 and a revolving axle 7. The vertical detection arm protruding structure 6 can be connected integrally with the subsidiary arm frame 4 and the vertical detection arm 5 in any well-known manner as long as the protruding structure 6, the vertical detection arm 5 and the subsidiary arm frame 4 can be rotated integrally. The subsidiary arm frame 4 as shown in the drawings can be divided into a fixed flange 13 with a plurality of threaded holes 130, a transitional portion 401 and an axle hole portion 402, these three portions being integral. The axle 7 includes an axles sleeve 12. The axle sleeve 12 includes an upper half axle sleeve 12' integral with the transitional portion 401 and a lower half axle sleeve 12" separable from the upper half axle sleeve 12' for the ease of installation. On the outer diameter of the revolving axle 7 is preferably provided in an axial direction a slot 8 having a length the same as the axial length of the axle sleeve 12 of the subsidiary arm frame 4 such that the axle sleeve 12 can be embedded into the slot 8. The subsidiary arm frame 4 can be secured to the revolving axle 7 by a fastening device such as a bolt device 10 so as to prevent the subsidiary arm frame 4 from running on the revolving axle 7. As shown in FIG. 5, the revolving axle 7 has a flange 13' on the position substantially aligned with the flange 13 in order to strengthen its connection with the vertical detection arm 5. In addition, the revolving axle 7 can be hollow, with a bearing axle 9 inserted into one end 30 having the flange 13' to further strengthen the bearing of the vertical detection arm 5. The hollow revolving axle 7 is connected with the revolving bearing 3 of the first connection arrangement 200 so as to realize the rotational connection between the vertical detection arm 5 and the main arm frame 1. For the ease of transportation, the vertical detection arm 5 is rotated upwardly around the bearing 3 until being disposed in the position where the vertical detection arm 5 parallel overlaps with the main arm frame 1 and is as close as possible to the main arm frame 1.

As can be recognized in FIG. 4, the vertical detection arm 5 is controlled by a hydraulic cylinder so as to achieve automatic unfolding and remain a working status thereof.

In the vehicle-mounted radiation imaging system 1000 using this kind of arm-folding mechanism 100, the control cabin 40 is preferably moved forward and adjacent to the driving cab 42.

Figure 7A:
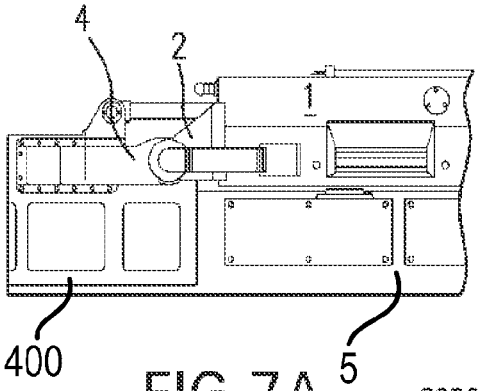
FIG. 7A is a frontal view of the vehicle-mounted system in a status of storage and transportation, according to an example embodiment of the present invention.
Figure 7B:
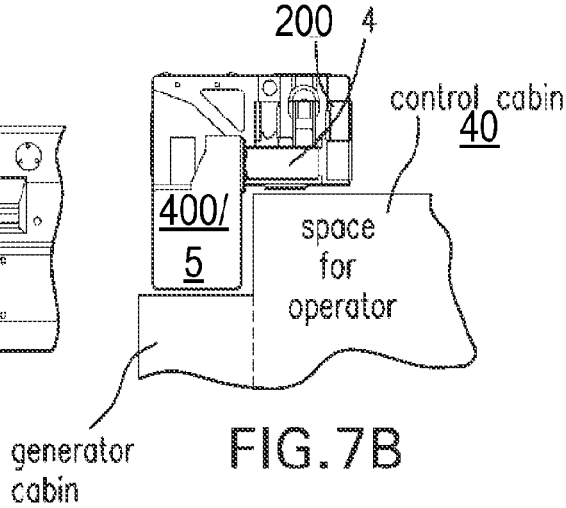
FIG. 7B is a side view of the vehicle-mounted system in a status of storage and transportation, according to an example embodiment of the present invention.
Figure 8:
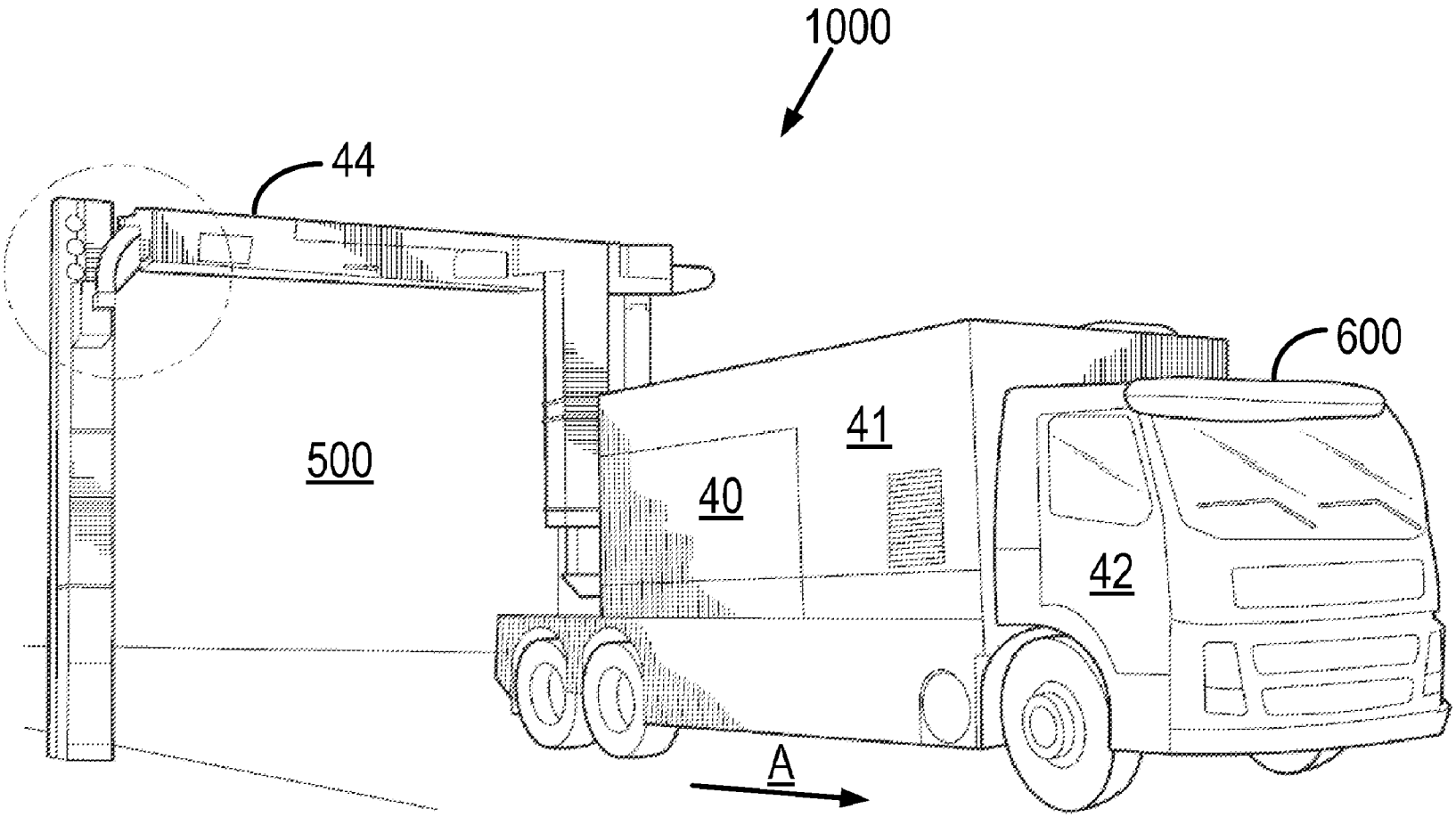
FIG. 8 (PRIOR ART)
FIG. 8, FIG. 9, and FIG. 10 are three dimensional views of the prior art arm-folding mechanism in a status of working and a status of folding as well as storage and transportation.
Figure 9:
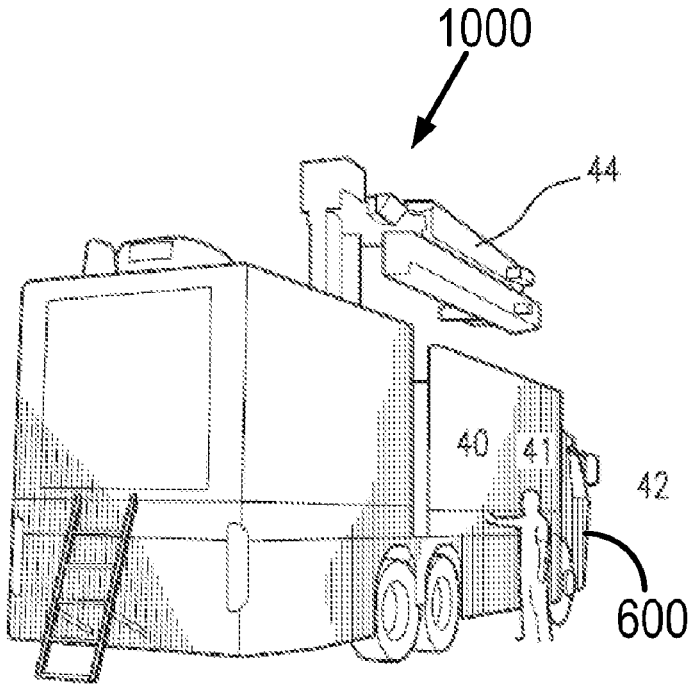
FIG.9 (PRIOR ART)
Figure 10:
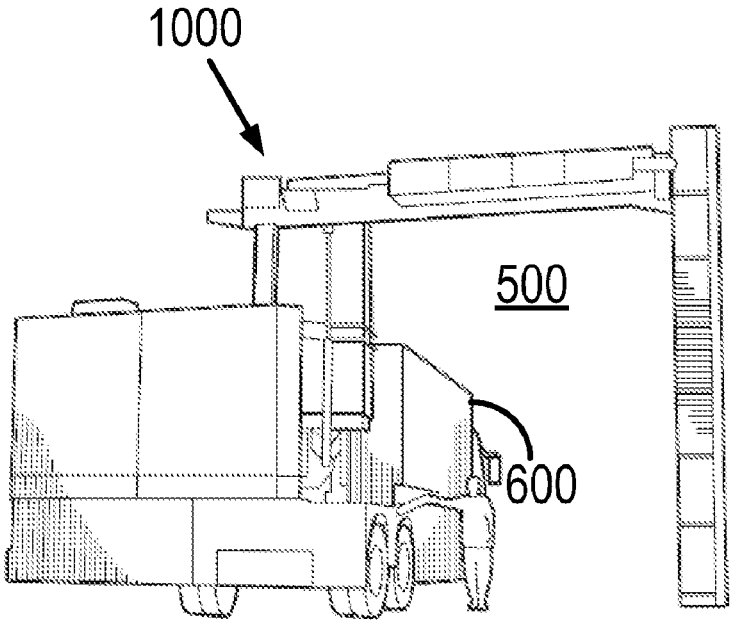
FIG.10 (PRIOR ART)
Figure 11B:
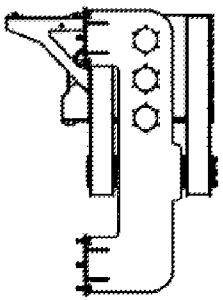
FIG. 11B (PRIOR ART)
FIGS. 11A, 11B and 11C are, respectively, a side view, a frontal view, and a top view of the hinged mechanism of the prior art arm-folding mechanism.
Figure 11A:
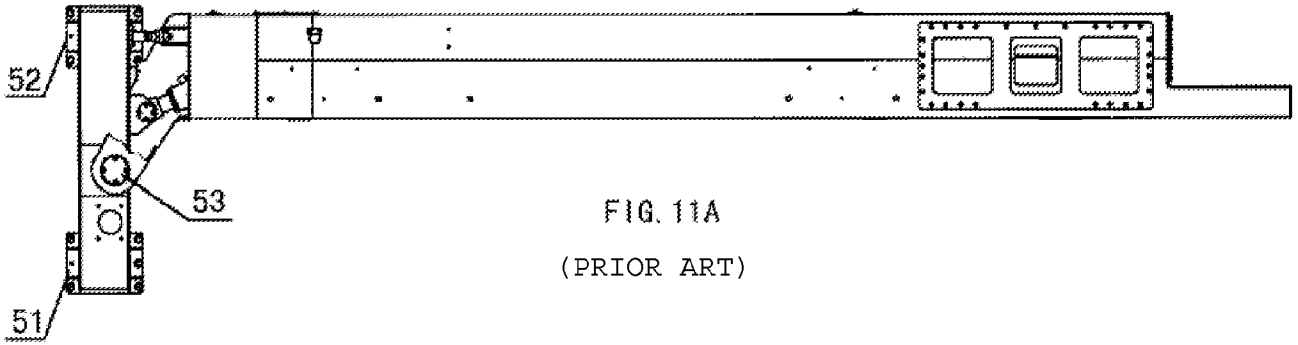
FIG. 11A (PRIOR ART)
Figure 11C:
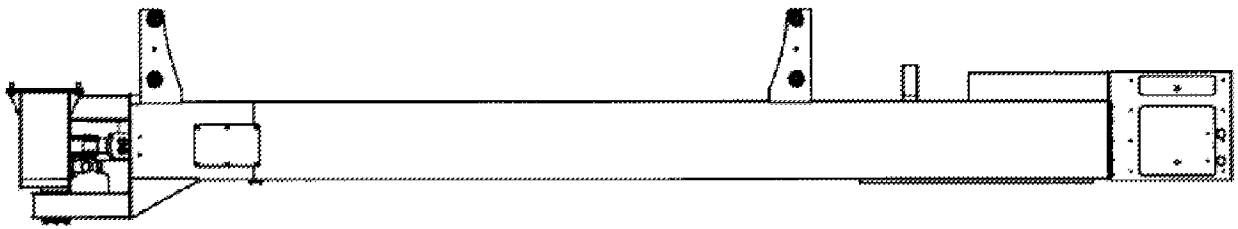
FIG. 11C (PRIOR ART)

Referring to FIGS. 7A and 7B, the following is a description to a folded status of the arm-folding mechanism 100, according to an example embodiment of the present invention. The vertical detection arm 5 is folded by an automatic control and located at the left side and underside of the main arm frame 1. Then the main arm frame 1 and the vertical detection arm 5 are rotated together towards the vehicle body until being located on top of the vehicle body and substantially parallel to the traveling direction A. As shown in FIG. 7B, the lowest position of the portion including the main arm frame 1 and the first connection arrangement 200 on the top of the control cabin 40 is above the control cabin 40 and parallel thereto. An equipment room is disposed at the position of the vertical detection arm 5 such that there is no particular requirement for space and comfortableness.

Those skilled in the art can appreciate from the foregoing description that the present invention may be implemented in a variety of forms, that the various embodiments may be implemented alone or in combination, and that the above described example embodiments are not used for limiting the present invention. Therefore, while the embodiments of the present invention have been described in connection with particular examples thereof, the true scope of the embodiments of the present invention should not be so limited since other modifications will become apparent to the skilled practitioner upon a study of the drawings, specification, and following claims. Many duplicate and alternative solutions will be apparent to those skilled in the art in light of the disclosed content of the present application and should fall within the protection scope of the present invention.

What is claimed is:

1. A vehicle-mounted radiation imaging system, comprising:

an arm-folding mechanism, the arm-folding mechanism comprising:

a vertical detection arm;

a main arm frame; and a hinged mechanism hingedly connecting the vertical detection arm with the main arm frame, the hinged mechanism including:

a first connection arrangement including a first end and a second end, the second end being one of fixedly connected to and integral with the main arm frame;

a second connection arrangement fixedly connected to the vertical detection arm; and an intermediate arrangement connecting the first connection arrangement with the second connection arrangement so that the vertical detection arm is rotatable relative to the main arm frame;

wherein a bottom of the first connection arrangement is one of at a same level as and above a bottom of the main arm frame.

2. The vehicle-mounted radiation imaging system according to claim 1, wherein a control cabin is adjacent to a driving cab, and a generator cabin is behind the control cabin.

3. The vehicle-mounted radiation imaging system according to claim 2, wherein a top of the control cabin is a flat-top structure, and a space of the control cabin is suitable for operators to operate therein.

4. The vehicle-mounted radiation imaging system according to claim 2, wherein a top of the control cabin is a flat-top structure and is higher than a top of the generator cabin.

5. The vehicle-mounted radiation imaging system according to claim 1, wherein, when the arm-folding mechanism is in an unfolded position, the first connection arrangement is near to a front side of the main arm frame with respect to a traveling direction of the vehicle.

6. The vehicle-mounted radiation imaging system according to claim 5, wherein the intermediate arrangement includes a subsidiary arm frame and a revolving axle fixedly connected to each other.

7. The vehicle-mounted radiation imaging system according to claim 6, wherein the subsidiary arm frame includes a fixed flange connected to the vertical detection arm and an axle sleeve fixedly connected to the revolving axle.

8. The vehicle-mounted radiation imaging system according to claim 7, wherein, at one end of the revolving axle aligned with the fixed flange, is provided a flange that secures the vertical detection arm and a bearing axle that carries the vertical detection arm and that is embedded in a hole of the end.

9. The vehicle-mounted radiation imaging system according to claim 8, wherein:

the axle sleeve is divided into detachably connected upper half and lower half axle sleeves, the upper half axle sleeve being one of connected to and integral with a body of the subsidiary arm frame; and a slot axially is arranged on an outer diameter of the revolving axle and includes a length equal to an axial length of the axle sleeve, such that the upper and lower half axle sleeves are embedded in the slot by a fastening element.

10. The vehicle-mounted radiation imaging system according to claim 8, wherein, when the arm-folding mechanism is in the unfolded position, the second connection arrangement is a protruding structure extending from the vertical detection arm to the main arm frame and beyond a width of the vertical detection arm, a detection passage being formed in the unfolded position.

11. The vehicle-mounted radiation imaging system according to claim 7, wherein, when the arm-folding mechanism is in the unfolded position, the second connection arrangement is a protruding structure extending from the vertical detection arm to the main arm frame and beyond a width of the vertical detection arm, a detection passage being formed in the unfolded position.

12. The vehicle-mounted radiation imaging system according to claim 6, wherein, when the arm-folding mechanism is in the unfolded position, the second connection arrangement is a protruding structure extending from the vertical detection arm to the main arm frame and beyond a width of the vertical detection arm, a detection passage being formed in the unfolded position.

13. The vehicle-mounted radiation imaging system according to claim 1, wherein the first end of the first connection arrangement is not directly connected to the main arm frame, is hingedly connected to the intermediate arrangement, and is laterally offset from the second end of the first connection arrangement, such that the first end is at a greater distance from the main arm frame than the second end.

14. The vehicle-mounted radiation imaging system according to claim 1, wherein the vertical detection arm performs an image detection operation.

15. The vehicle-mounted radiation imaging system according to claim 14, wherein the arm-folding mechanism is configured to unfold such that the main arm frame extends away from a side of the vehicle extending between a front end and back end of the vehicle, and the vertical detection arm extends downwards from the main arm frame, thereby forming an image detection passage between the side of the vehicle and the vertical detection arm.

16. The vehicle-mounted radiation imaging system according to claim 1, wherein the arm-folding mechanism is configured to unfold such that the main arm frame extends away from a side of the vehicle extending between a front end and back end of the vehicle, and the vertical detection arm extends downwards from the main arm frame, thereby forming an image detection passage between the side of the vehicle and the vertical detection arm.

17. The vehicle-mounted radiation imaging system according to claim 1, wherein:

the vertical detection arm includes a first end hingedly connected to the main arm frame and a second end; and the arm-folding mechanism is configured to unfold such that the vertical detection arm extends from the first end of the vertical detection arm to the second end of the vertical detection arm in a direction that is perpendicular to a driving direction of the vehicle and parallel to a side of the vehicle that extends between a front and a back of the vehicle.

* * * * *